US009468344B2

(12) United States Patent
Eiichi

(10) Patent No.: US 9,468,344 B2
(45) Date of Patent: Oct. 18, 2016

(54) WET SUCTION ATTACHMENT

(71) Applicants: KAWAMOTO TECHNICAL LABORATORY INC., Hiroshima (JP); OFFICE TOMIOKA INC., Tokyo (JP)

(72) Inventor: Kawamoto Eiichi, Hiroshima (JP)

(73) Assignees: KAWAMOTO TECHNICAL LABORATORY INC., Hiroshima (JP); OFFICE TOMIOKA INC., Tokyo (JP)

( * ) Notice: Subject to any disclaimer, the term of this patent is extended or adjusted under 35 U.S.C. 154(b) by 1 day.

(21) Appl. No.: 14/441,026

(22) PCT Filed: Oct. 31, 2013

(86) PCT No.: PCT/JP2013/080171
§ 371 (c)(1),
(2) Date: May 6, 2015

(87) PCT Pub. No.: WO2014/073625
PCT Pub. Date: May 15, 2014

(65) Prior Publication Data

US 2015/0297048 A1 Oct. 22, 2015

(30) Foreign Application Priority Data

Nov. 7, 2012 (JP) ..... 2012-245380

(51) Int. Cl.

| | |
|---|---|
| ***A47L 7/00*** | (2006.01) |
| ***A47L 5/22*** | (2006.01) |
| ***A47L 9/24*** | (2006.01) |
| ***A47L 11/40*** | (2006.01) |

(52) U.S. Cl.
CPC ..... *A47L 7/0023* (2013.01); *A47L 5/225* (2013.01); *A47L 7/0004* (2013.01); *A47L 9/242* (2013.01); *A47L 11/4016* (2013.01); *A47L 11/4083* (2013.01); *A47L 11/4088* (2013.01)

(58) Field of Classification Search
CPC ... A47L 5/225; A47L 7/0004; A47L 7/0023; A47L 9/242; A47L 11/4016; A47L 11/4083; A47L 11/4088
USPC ..... 15/320, 328
IPC ..... A47L 7/00
See application file for complete search history.

(56) References Cited

U.S. PATENT DOCUMENTS 5,210,902 A 5/1993 Lee et al.

FOREIGN PATENT DOCUMENTS

| | | | |
|---|---|---|---|
| JP | 1-155950 | U | 10/1989 |
| JP | 2-29646 | U | 2/1990 |
| JP | 4-56440 | U | 5/1992 |
| JP | 5-13336 | U | 2/1993 |
| JP | 2721280 | B2 | 3/1998 |
| JP | 2002-315809 | A | 10/2002 |
| JP | 2005-131240 | A | 5/2005 |
| JP | 2007-14641 | A | 1/2007 |
| JP | 2007-54352 | A | 3/2007 |
| JP | 2008-49102 | A | 3/2008 |
| JP | 2010-142390 | A | 7/2010 |

OTHER PUBLICATIONS

International Search Report dated Feb. 4, 2014 issued in correspondig application No. PCT/JP2013/080171.

*Primary Examiner* — David Redding
(74) *Attorney, Agent, or Firm* — Westerman, Hattori, Daniels & Adrian, LLP

(57) ABSTRACT

The present invention provides a wet suction attachment with which a dry-type vacuum cleaner can be easily modified so as to function as a wet-type vacuum cleaner. A wet-type suction attachment according to the present invention is provided with: a sewage tank (1) having a circular peripheral surface in a horizontal cross section; a solution or cleaning fluid tank (2) provided below the sewage tank (1); a suction head (3) in which both a suction opening (f1) and an outflow opening (f2) are provided; an extension tube (13) which anteriorly extends from the solution tank (1), and which has one end thereof communicating with the suction opening (f1) in the suction head (3), and another end thereof opening to the inside of the solution tank (1); a solution passage (15) for guiding the solution in the solution tank (2) to the outflow opening in the suction head (3); a separation processing unit (5) equipped with a fan (9*b*) which is provided to a lid (1*c*) for covering an upper space of the waste water tank (1), and which is rotated by suction air, said separation processing unit wherein, on the one hand, a dish body (9*a*) which protrudes in the sewage tank (1) as a result of rotary force rotates to cause air sucked into the sewage tank (1) from the suction opening (f1) to flow into the fan (9*b*) via slits (b2) in the dish body (9*a*), and, on the other hand, the solution mixed with dirt and sucked into the sewage tank (1) from the suction opening (f1) is scattered by centrifugal force caused by the rotation of the dish body (9*a*) so as to be made to pass through the slits (b2), and is stored in the waste water tank (1); a gripper (6) which is positioned horizontally between the solution tank (2) and the separation processing unit (5), which is uprightly fixed to the sewage tank (1) with a space therebetween, and which has a duct provided vertically therein; an outlet tube (19) which has, connected thereto, an upper side of the duct in the holding unit (6), and into which air flowing into the fan (9*b*) of the separation processing unit (5) is sucked; and a coupling end (22) which connects a lower side of the duct in the gripper (6) to an air hose of a dry-type vacuum cleaner (101) such that the orientation of the duct is changed to a horizontal direction.

4 Claims, 4 Drawing Sheets

WET SUCTION ATTACHMENT

TECHNICAL FIELD

The present invention is related to a wet suction attachment for functionally changing from a dry vacuum cleaner to a wet vacuum cleaner which supplies a solution or cleaning liquid onto the surface to be cleaned and in which the surface to be cleaned is sucked to remove dirt on the surface to be cleaned.

BACKGROUND

As conventional wet vacuum cleaner, for example, Patent Document 1 discloses a vacuum cleaner in which water is sprayed on the floor to clean the floor surface while to suck to remove the water and dirt dissolved on the floor surface.

Also, Patent Document 2 shows a cleaning device for removing dirt excrement or the like attached to a body surface of the caregiver, such as elderly or sick. The conventional device is constructed so that the warm water is injected to wash away the dirt excrement or the like, while the warm water used to wash the body surface, with containing the excrement or the like is accumulated in sewage tank.

Patent Document 1: Japanese Patent Publication No. 2005-131240

Patent Document 2: Japanese Patent Publication No. 2002-315809

The device disclosed in Patent Documents 1 and 2 described above, serves as a wet dedicated vacuum cleaner that comprises an electric blower for sucking contaminated water, and a sewage tank to store the contaminated water, in a housing of the cleaner device. However, it is difficult to keep own such special-purposed dedicated cleaner for home-use, for small applications such as spilled source on the carpet by child, as well as an excrement or the like thereon by pets.

SUMMARY OF THE INVENTION

The present invention aims to provide a normal attachment which can be easily changed functionality to wet vacuum cleaner even using a dry vacuum cleaning device that is usury standing in the home.

A wet suction attachment of the present invention, according to a first embodiment, is characterized by comprising a sewage tank having a periphery with a circular shape in horizontal cross-section, a solution tank which is disposed beneath the sewage tank, a suction head having both of an outflow opening and a suction opening, an extension tube which extends from the sewage tank forwards, one end of which communicates with the suction opening of the suction head, and the other end of which is open inside the sewage tank, a solution passage for guiding the solution in the solution tank to the outlet opening of the suction head, a separation processing unit provided to a lid for covering the upper space of the sewage tank, having a fan which rotates by the suction air, rotating a dish body which is protruded into the sewage tank by the rotating force of the fan, causing the air which is suctioned from the suction opening into the sewage tank, to flow into the fan through slits formed to the dish body, while storing the solution into the sewage tank by splashing it by the centrifugal force due to the rotation of the dish body, even though the solution which includes dirt suctioned from the suction opening to the sewage tank, enters therein through the slits, a gripper having a vertical conduit therein, being fixed in a standing position at a distance from the sewage tank, with a horizontal transverse position between the solution tank and the separation processing unit, an outlet pipe connected to an upper conduit of the gripper, for sucking the air flowing into the fan of the separation processing unit, and a coupling end portion connected to an air hose of a dry vacuum cleaner, by changing the orientation of the lower side of the conduit of the gripper.

A wet suction attachment of the present invention, according to a second embodiment, is characterized by further comprising a socket for being capable of separating the outlet pipe from the upper side of the conduit of the gripper when removing the lid from the sewage tank.

A wet suction attachment of the present invention, according to claim 1, is characterized in that the solution tank is separable from the sewage tank.

A wet suction attachment of the present invention, according to claim 1, is characterized in that the capacity of the solution tank is set to be smaller than that of the sewage tank.

BEST MODE FOR CARRYING OUT THE INVENTION

Hereinafter, a description of preferred embodiment according to the wet suction attachment of the present invention will be given with reference to accompanying drawings.

Figure 1A:
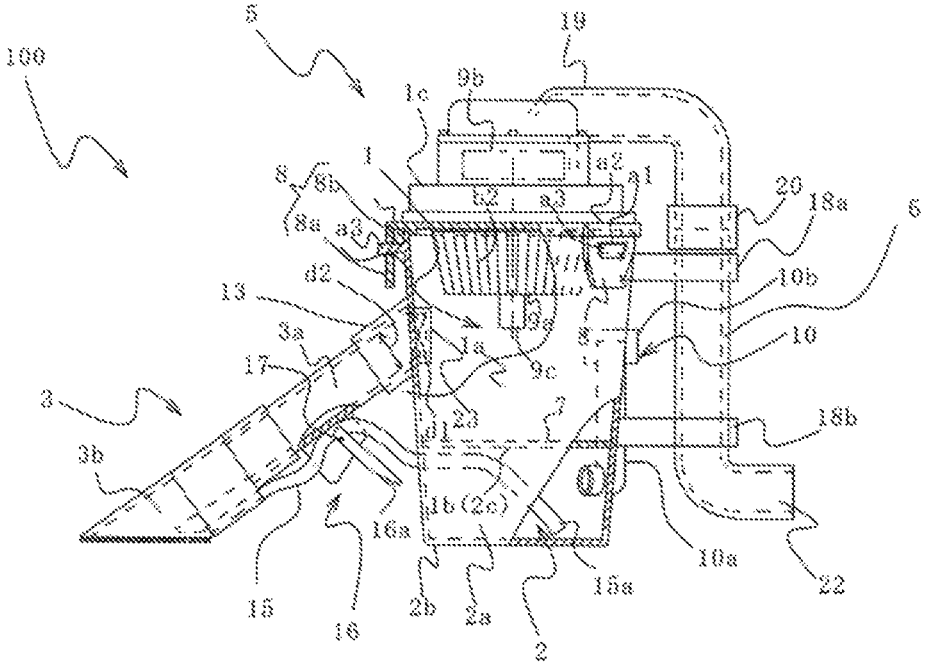
FIG. 1A indicates a partial cross-sectional view showing by taking partial section of an example of the configuration of an embodiment of the wet suction attachment according to the present invention.

In FIG. 1A, a wet suction attachment 100 according to the present embodiment, is provided with a sewage tank 1 for storing a sewage or liquid which was used to a cleaning operation, a solution tank 2 for containing a solution or cleaning liquid, and a separation processing unit 5 in a main container 110. The attachment 100 is further provided with a gripper 6, an extension tube 13 for connecting with a suction head 3, and a coupling end portion 22 connected to an air hose (h) of a dry vacuum cleaner 101, out of the main container 110.

The sewage tank 1 is arranged on the upper side in the main container 110 while the solution tank 2 on the lower side therein so as to be stacked each other. The sewage tank 1 is constructed to be circular in horizontal cross-section, and has a circular-shaped base surface portion 1*b* and a conical periphery 1*a* of increasing radius as it goes upward from the circular base portion 1*b*, while the upper space thereof is covered by a lid 1*c* which seals the inner space of the sewage tank 1 along the upper edge of the conical periphery 1*a*.

The base surface portion 1*b* is formed by the partition plate 7 for partitioning the interior volume of the main container 110 up and down. The lid 1*c* incorporates the separation processing unit 5, as shown in FIG. 2B, and is secured to the main container 110 with being detachably from the sewage tank 1 through a plurality of (for example, 4 (four)) engaging portions 8.

It should be noted that, in this embodiment, the capacity of the solution tank 2 is set to be smaller than that of the sewage tank 1. Thus, an operator even run out of all the solution from the solution tank 2 for example, it is possible to reliably prevent the solution containing dirt which has been collected, overflowing in the sewage tank 1.

Figure 2A:
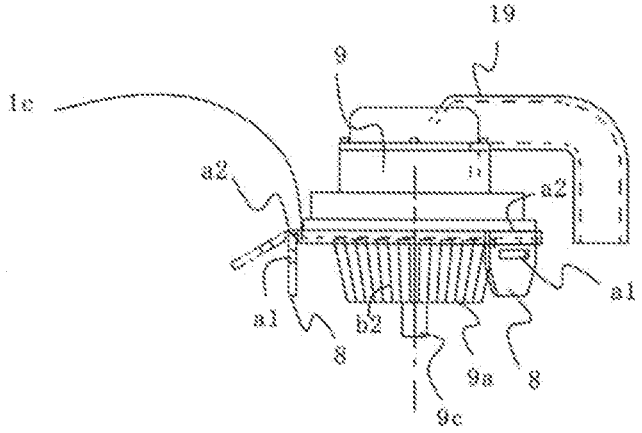
FIG. 2A shows a view of the lid in an independent form wherein the lid is separated from the attachment shown in FIG. 1A.
Figure 2B:
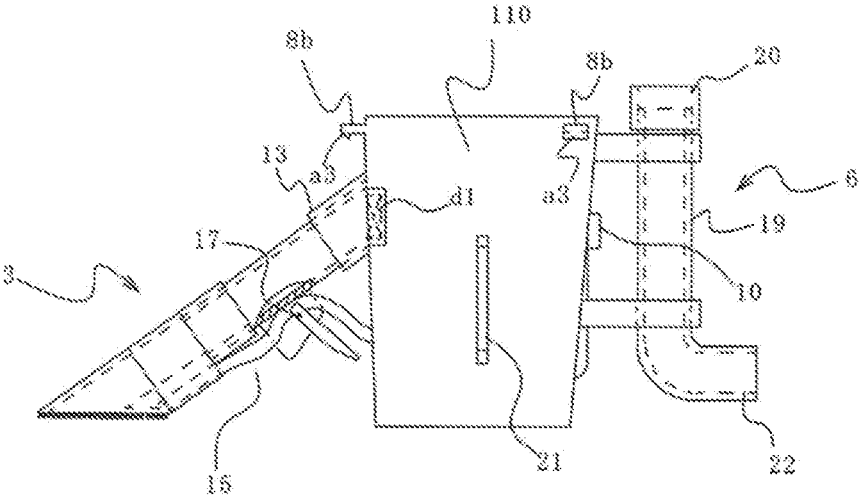
FIG. 2B indicates a view illustrating a state after removing the lid from the attachment shown in FIG. 1A.

In FIG. 2A, the lid 1*c* is shown in a state detached from the main container 110, each of the engaging portion 8 is constructed by a tongue 8*a* which is pivoted, and a hook-like projection 8*b* which is fitted to a locking hole (a1) of the tongue 8*a* so as to be hooked to be inserted therein.

The separation processing unit 5 provided in the lid 1*c* is constructed so as to sort or select the air from the solvent that is sucked with air into the sewage tank 1 through the suction head 3 as well as the dirt and dust contained in the solution, and then flow out toward the outlet tube 19. The separation processing unit 5 is intended to carry out the air-water separator for separating air from liquid, and is constructed by a dish body 9*a*, a fan 9*b* which is rotated by the air flow, and a shaft portion 9*c* for transmitting the rotation of the fan 9*b* to the dish body 9*a*. The dish body 9*a* is formed so as to have a number of inclined slits (b2) on the circumferential surface thereof, to stop the ingress of water into the dish body 9*a* in by rotating, and to flow the air to the inside thereof through the slit (b2). Air flowing into the inner area flows into the fan 9*b*, and then is sucked through the outlet tube 19 by rotating the fan (9*b*).

As shown in FIG. 1A, arranged on the lower side of the sewage tank 1 is the solution tank 2. The solution tank 2 has a circular surface 2*a*, and a bottom portion 2*b*, and a top wall 2*c* shares the partition plate 7 forming a bottom surface portion 1*b* of the sewage tank 1. Provided on the circumferential surface 21 is a solution receiving unit 10 which has a solution supplying tube 10*a* and a lid 10*b* for openably closing an opening of the upper end thereof. The solution supplying tube 10*a* is open into the circular surface 2*a* at the lower end opening (c1), and it is set higher than the top wall 2*c*. The lid 2*b* is formed with an air vent hole in order to enter and leave the air in the solution tank 2. The lid 2*b* is opened where the solution such as water, for example, is supplied in the solution tank 2.

The extension tube 13 is open through a nozzle 23 into the sewage tank 1 at the rear end through the conical periphery 1*a*. An opening (d1) of the nozzle 23 has a smaller opening area than the cross sectional area (d2) through which air passes in the extension pipe 13, the input flow rate of the sewage into the tank 1 is adapted to rise. In addition, the opening (d1) of the nozzle 23 is open toward the circumferential direction along the air flow from the extension tube 13 to the conical peripheral surface 1*a*. Outside of the nozzle 23, it has become the guide wall 23*a* to draw a continuous curve with the conical peripheral surface 1*a*, the wastewater circulating in the sewage tank 1 is adapted to circulate beyond the top of the guide wall 23*a*.

Figure 1B:
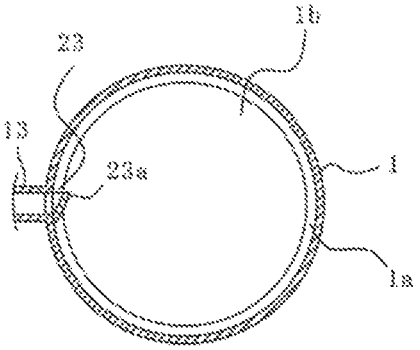
FIG. 1B denotes a plan sectional view showing a mounted state of the extension tube to the sewage tank.

As shown in FIG. 1B, the extension tube 13 is extended obliquely downward slightly forward from the sewage tank 1, the suction head 3 is connected to the distal of the extension tube 13. The suction head 3 has a mouth tube 3*a* to be inserted into the extension pipe 13 and passage portion 3*b*, the internal space of which is widened in the lateral direction gradually toward the mouth tube 3*a* forward.

A solution passage 15 is provided between the suction head 3 and the solution tank 2. When it becomes negative pressure in the solution tank 2, the solution flows from the cleaning liquid tank 2 at atmospheric pressure through the solution passage 15 toward the suction head 3. The suction head 3 has a flow rate adjuster 16 in the middle point thereof. The flow rate adjuster 16 is intended to be configured so as to elastically deform the middle portion of the solution passage 15 into a flat shape, and has a handle 16*a*. When the handle 16*a* is operated so as to swing about the support shaft 17, the solution passage 15 is sandwiched between the handle 16*a* and the extension tube 13, thereby being elastically deformed so as to confine the solution therein.

Figure 4A:
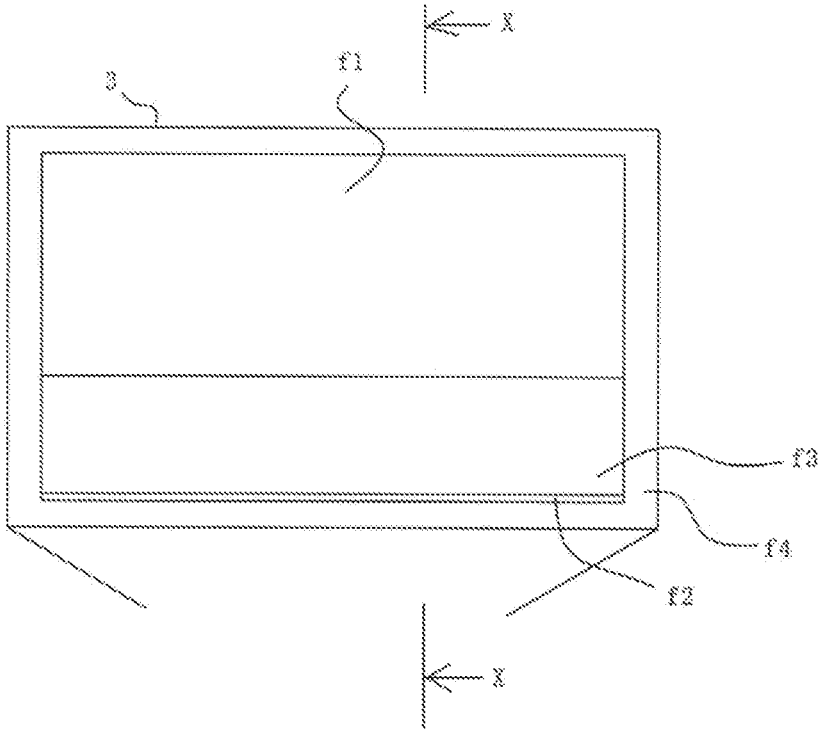
FIG. 4A shows a view of suction head wherein the suction head is retrieved from the attachment shown in FIG. 1A.
Figure 4B:
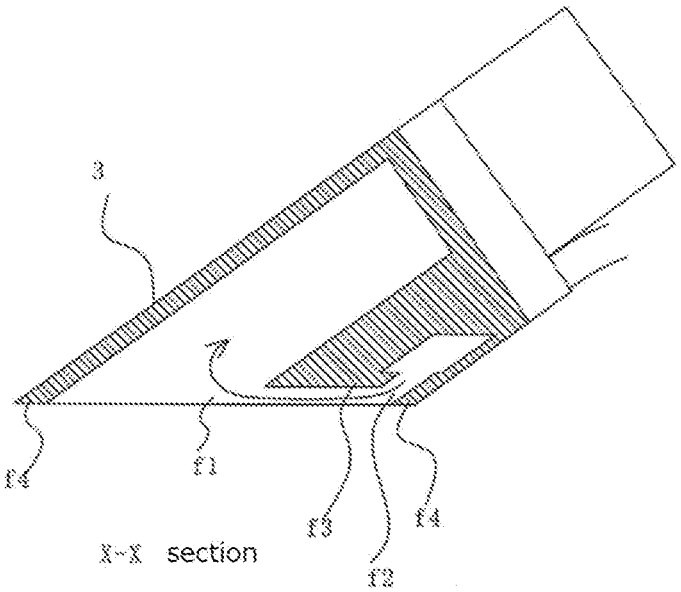
FIG. 4B indicates a sectional view showing a state where the suction head shown in FIG. 4A is taken along the line X-X.

FIG. 4A indicates the lower surface of the suction head 3, while FIG. 4B shows the X-X cross-section of the suction head 3. Into a surrounding surface (f4) which defines an outer periphery of the bottom of the suction head 4, a suction opening (f1) which is configured by an elongated shape extending laterally, and through which suction negative pressure is guided by the extension tube 13 and an outflow opening (f2) through which the solution is guided by the solution passage 15 are featured with sandwiching a boundary (f3). Both sides of the boundary (f3) which are opposing to each to each other define abysses of the suction opening (f1) and the outflow opening (f2), respectively, and its height set to be is higher than the recessed surrounding surface (f4). Therefore, when the surrounding surface (f4) abuts against the surface to be cleaned, a gap is formed between the lower surface of the boundary (f3) and the surface to be cleaned. By the solution to flow from the outflow opening (f2) to the suction opening (f1) through the gap, the dirt soup or the like adhering to the surface to be cleaned is to be dissolved. Also, the brush would be provided, if necessary, on the surrounding surface (f4).

Figure 3:
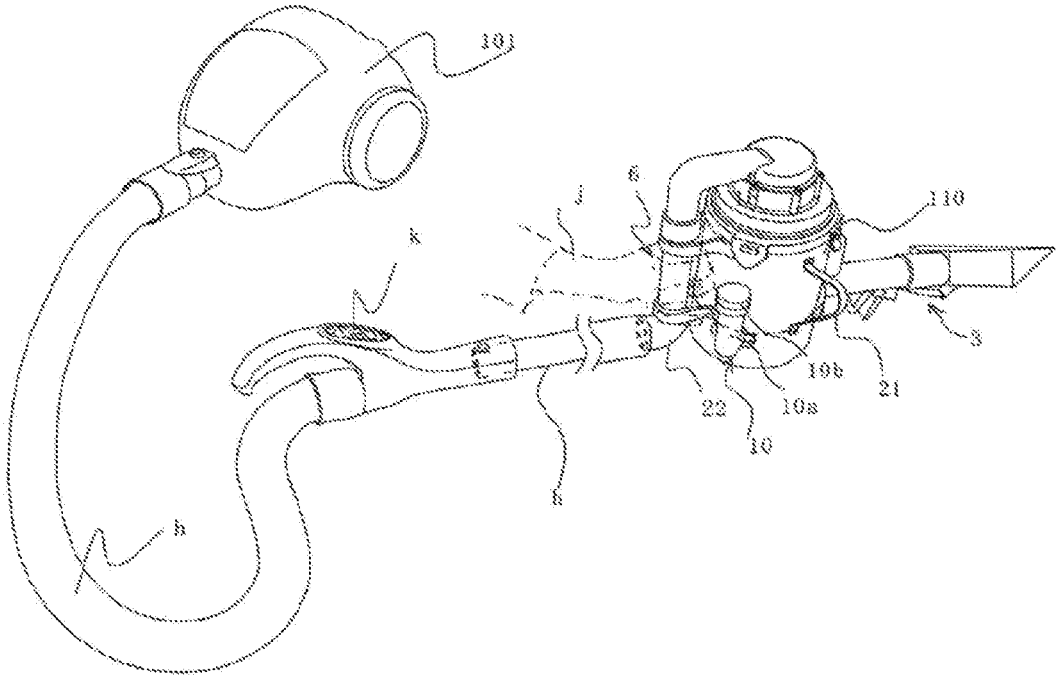
FIG. 3 denotes a view of the attachment shown in FIG. 1A wherein the attachment is connected to the dry cleaner.

As again shown in FIG. 1A, the gripper 6 is fixed on the rear side of the sewage tank 1 in a standing posture. In the present embodiment, the gripper 6 is fixed to the sewage tank 1 through a holding member 18*a*, whereas, the holding member 18*b* is disposed in a state of straddling the solution tank 2, the gripper 6 is fixed to the main container 110 by both of the holding members in the bridge-like manner. The inside of the gripper 6 is defined by a tube which extends vertically. To the upper end of the gripper 6, a socket 20 is fitted into an outlet tube 19 in a removable state with respect to the interior of the conduit of the gripper 6. As shown in FIG. 3, the lower end of the inner conduit of the gripper 6 is bent by 90 degrees with respect to a airflow direction in the horizontal direction, and the air hose (h) of the vacuum dry cleaner 101 via the coupling end portion 22 is connected. The gripper 6 is provided at a distance from the main container 110 between the solution tank 2 and the separation processing unit 5. This position is corresponding to a state wherein the solution tank 2 is filled with the solution and wherein the main container 110 to which the lid 1*c* is mounted is positioned on the horizontal side of the center of gravity of the main container 110.

Even though the container body 110 has tipped over, as shown in FIG. 3, to the outer surface of one of left and right sides of the body container 110, side legs 21 are provided in a state of projecting to the lateral direction, in order that the sewage in the main container 110 does not enter into the separation processing unit 5.

Then, a description will be given about an example using the wet suction attachment 100 of the present embodiment as described above.

At first, in the state where the flow rate adjuster 16 is closed, the solution is supplied into the solution tank 2 by opening the lid 10*b* of the solution receiving unit 10, and then the lid 10*b* is closed.

The opening of the distal end of the air hose (h) of the electrical cleaner or dry vacuum cleaner 101 as the dry vacuum cleaner is fitted to the coupling end portion 22. The operator is allowed to start by operating the switch (k) of the electrical cleaner 101, and grips the gripper 6 by hand (j), to abut the suction opening (f1) of the suction head 3 against the surface to be cleaned, such as the dirt surface of the carpet.

The dry vacuum cleaner 101 is started to suck the air through the outlet tube 19, the dish body 9*a*, the sewage tank 1 and the suction head 3. When performing the washing with the solution or washing liquid, the solution passage 15 is set to be in the open state by operating the handle 16*a*. Thus, the negative pressure of the suction opening (f1) of the suction head 3 is propagated to the outlet opening (f2) along the lower surface of the boundary (f3). As a result, the solution in the solution tank 2 flows out from the outflow opening (f2) onto the surface to be cleaned, thereby dissolving the dirt of soup or the like attached to the surface to be cleaned.

The solution existing on the surface to be cleaned and mixed soil components in the solution and the dust scattered on the surface to be cleaned flow into the sewage tank 1 through the suction opening (f1). They flow to move along the conical periphery 1*a* in a state where the flow rate is increased to the nozzle. The swirl flow has been generated in the sewage tank 1 about the central axis thereof, by the rotation of the dish body 9*a*. Thus, the centrifugation has been occurred in the sewage tank 1, and then the sewage that has been centrifuged in the sewage tank 1 drops down into the solution tank 2. The dish body 9*a* splashes the sewage which has been falling down into the outlet tube 19 through the slits (b2) by the centrifugal force due to rotation, thereby preventing the entry into the outlet tube 19. Accordingly, the air flow in the outlet tube 19 is guided to the dry electric vacuum cleaner (k1) through the gripper 6 and the coupling end 22.

When the sewage in the sewage tank 1 is accumulated to a required level to be emitted, as shown in FIG. 2A and FIG. 2B, the engagement between the main container 110 and the lid 1*c* through the engaging portions 8 is disengaged. Then, the sewage stored in the sewage tank 1 is discarded.

In the present embodiment, by connecting the air hose (h) of the dry vacuum cleaner 101 to the lower side of the gripper 6, it is avoided that the air hose (h) interferes with movement of the hand (j).

The sewage tank 1 is disposed above the solution tank 2. It is required that the depth of the sewage tank 1 is set to be deeper than that of the solution tank 2, because the sewage tank 1 contains the dish body 9*a* therein. Since the heavy goods or items such as the solution and the sewage are set to be positioned below the gripper 6, whereas the separation processing unit 5 is set on the upper side of the gripper 6, the center of gravity of the attachment 100 is positioned to be near the grip section 6, it is easy maneuverability attachment 100.

Further, since it does not significantly change the height of the attachment 100 even though the center of gravity is raised up due to movement of the sewage from the solution tank 2 to the sewage tank, the maneuverability is not deteriorated. Should the solution tank 2 is set to be above the sewage tank 1, it will be difficult maneuverability since the center of gravity is positioned on the upper side of the gripper 6, at the beginning of the cleaning. Also, the center of gravity variation is large since the height of the solution moving in the cleaning becomes larger.

By placing the sewage tank 1 on the upper side of solution tank 2, the suction air from the dry electrical suction cleaner 101 must be introduced for separation processing unit 5 provided in the lid 1*c* of the sewage tank, the gripper 6 is responsible for this role. A size or diameter of the tube which controls the air volume of the conventional electric vacuum cleaner 101 is due to substantially the size of grip by the palm of the operator, the suction air of the dry vacuum cleaner 101, which is introduced from the lower position where it does not interfere with the attachment 100, is sent to the separation processing unit 5 by utilizing the internal space of the gripper 6.

The present invention is not limited to the configuration of the above-described embodiment, it is needless to say various modifications may be made without departing from the scope or gist of the present invention.

For example, in the above described embodiment, although the internal space of the main container 110 is divided up and down by the partition plate 7, the present invention is not limited to such a construction, it may be as a possible to separate the solution tank 2 from the body container 110. More specifically, for example, a screw may be provided on the lower surface of the sewage tank 1, the solution tank 2 may be attached to crowded screw from below to the sewage tank 2.

INDUSTRIAL APPLICABILITY

According to the wet suction attachment of the present invention, by using a dry vacuum cleaner which is provided in advance in the home or the like, it is possible to perform the wet vacuum cleaning. Thus, it is not necessary to own both the dry vacuum cleaner and a wet vacuum cleaner, whereby it is possible to achieve the cost effect. Further, the gripper is provided with a vertical pipe therein, the upper side thereof is connected to the separation processing unit, while the lower side thereof is connected to the dry vacuum cleaner. By serving the gripper and the conduit, the flow of the suction air is regulated as well as is intended to grip easily. Also, since the centered on the gripper, the separation processing unit is set on the upper side and the solution tank filled with the solution therein on the lower side, the present invention has the effect of upper and lower weight balance is very good, thus the use of its industrial potential is extremely high.

What is claimed is:

1. A wet suction attachment which comprises:

a sewage tank having a periphery with a circular shape in horizontal cross-section, a solution tank which is disposed beneath the sewage tank, a suction head having both of an outflow opening and a suction opening, an extension tube which extends from the sewage tank forwards, one end of which communicates with the suction opening of the head, and the other end of which is open inside the sewage tank, a solution passage for guiding the solution in the solution tank to the outlet opening of the suction head, a separation processing unit provided to a lid for covering the upper space of the sewage tank, having a fan which rotates by the suction air, rotating a dish body which is protruded into the sewage tank by the rotating force of the fan, causing the air which is suctioned from the suction opening into the sewage tank, to flow into the fan through slits formed to the dish body, while storing the solution into the sewage tank by splashing it by the centrifugal force due to the rotation of the dish body, even though the solution, which includes dirt suctioned from the suction opening to the sewage tank, enters therein through the slits, a gripper having a vertical conduit therein, being fixed in a standing position at a distance from the sewage tank, with a horizontal transverse position between the solution tank and the separation processing unit an outlet pipe connected to an upper conduit of the gripper, for sucking the air flowing into the fan of the separation processing unit, and a coupling end portion connected to an air hose of a dry vacuum cleaner, by changing the orientation of the lower side of the conduit of the gripper.

2. The wet suction attachment according to claim 1, which further comprises:

a socket for being capable of separating the outlet pipe from the upper side of the conduit of the gripper when removing the lid from the sewage tank.

3. The wet suction attachment according to claim 1, wherein the solution tank is separable from the sewage tank.

4. The wet suction attachment according to claim 1, wherein the capacity of the solution tank is set to be smaller than that of the sewage tank.

* * * * *